US006113986A

United States Patent [19]

Shanton et al.

[11] Patent Number: 6,113,986

[45] Date of Patent: Sep. 5, 2000

[54] COATED BASE PRODUCTS, APPARATUS AND PROCESS FOR PRODUCING SAME

[75] Inventors: Kenneth John Shanton, Neenah; Erland R. Sandstrom, Menasha; Timothy Paul Hartjes, Kimberly; Dean Patrick Swoboda, DePere, all of Wis.

[73] Assignee: Fort James Company, Deerfield, Ill.

[21] Appl. No.: 09/004,611

[22] Filed: Jan. 8, 1998

Related U.S. Application Data

[63] Continuation of application No. 08/595,241, Feb. 1, 1996, abandoned.

[51] Int. Cl.[7] ..... B05D 3/12

[52] U.S. Cl. ..... 427/356; 427/359; 427/365

[58] Field of Search ..... 427/428, 359, 427/356, 365, 366

[56] References Cited

U.S. PATENT DOCUMENTS

| | | | |
|---|---|---|---|
| 2,157,286 | 5/1939 | Emmey . | |
| 2,213,117 | 8/1940 | Blackmore . | |
| 3,607,486 | 9/1971 | Jacks et al. . | |
| 3,918,397 | 11/1975 | Thettu . | |
| 4,012,543 | 3/1977 | Ranger et al. | 427/361 |
| 4,308,320 | 12/1981 | Schiller | 428/511 |
| 4,344,379 | 8/1982 | Roberts . | |
| 4,358,481 | 11/1982 | Wallstén . | |
| 4,370,389 | 1/1983 | Ogura et al. | 428/511 |
| 4,603,060 | 7/1986 | Mitsuda et al. . | |
| 4,857,126 | 8/1989 | Soremark et al. | 156/205 |
| 4,949,667 | 8/1990 | Yoshida et al. . | |
| 4,973,441 | 11/1990 | Keller | 264/280 |
| 5,328,511 | 7/1994 | Beisswanger . | |
| 5,378,497 | 1/1995 | Johnson et al. | 427/361 |

OTHER PUBLICATIONS

BASF Corporation Technical Information Sheet re: "Acronal S504—Binder for Coating Paper and Paperboard"—1991, no page numbers or month.

Product Description Sheet for Cargill Industrial Corn Starch, 1993, no page numbers or month.

Technical Bulletin PA–19, "KELGIN Sodium Alginate for Surface Treatment of Paper and Paperboard," Kelco (Division of Merck & Co., Inc.), no page numbers or date.

*Primary Examiner*—Shrive Beck
*Assistant Examiner*—Bret Chen
*Attorney, Agent, or Firm*—Finnegan, Henderson, Farabow, Garrett & Dunner, L.L.P.

[57] ABSTRACT

A method of applying a coating to a surface of a base product that includes providing a calender stack that includes a rotatable king roll and a feeding roll is provided. The king roll is opposed to the feeding roll to define a nip portion between the rolls. A cleaning blade is provided and placed in contact with the king roll and a calender box is provided and placed adjacent a surface of the king roll. A coating material is applied to the surface of the king roll utilizing the calender box. A base product is passed through the nip portion to apply the coating material to a surface of the base product to form the coating thereon.

5 Claims, 2 Drawing Sheets

COATED BASE PRODUCTS, APPARATUS AND PROCESS FOR PRODUCING SAME

This is a continuation of application Ser. No. 08/595,241 filed Feb. 1, 1996, now abandoned, of Kenneth J. SHANTON, et al. for COATED BASED PRODUCTS APPARATUS AND PROCESS FOR PRODUCING SAME all of which are incorporated herein by reference.

FIELD OF THE INVENTION

The present invention relates to grease, oil, wax and solvent resistant coated base products having superior soak through resistance. The present invention further relates to an apparatus and method for the application of a coating to a base product to impart grease, oil, wax and solvent resistance. More particularly, the present invention relates to high solids, for example high solids pigmented latex, coated base products and an apparatus and method for applying high solids coatings to base products.

BACKGROUND OF THE INVENTION

Coatings to impart grease, oil, wax or solvent repellency to certain base products have been known for some time. Demand for such coated products has grown enormously in recent years. In order to meet this demand, new coating compositions, coated base products, and apparatus and methods for applying such coatings to base products must be constantly developed and improved.

Additionally, manufacturers of coated base products strive to improve the physical properties of the base products, for example, improved rigidity, not only to produce superior products, but also to improve the safety of the manufacturing process. For example, paperboard is prone to frequent web breaks on the printing press. This can be a fire hazard. For instance, if a web break should occur in the dryer section of the printing operation a fire could be initiated.

Manufacturers have also been striving to develop coated base products that display no pinholes. This fosters the use of the coated base products in new applications. For example, because the coating displays no pinholes, the coating is impervious to ink. Not all inks are approved by the FDA for contacting food. This makes it is possible to utilize coated base products with all over print designs in applications in which a printed portion of the base product could contact food products, irrespective of whether the ink used is approved by the FDA for contacting food.

SUMMARY OF THE INVENTION

Accordingly, the present invention is directed to an improved coated base product that overcomes the limitations and disadvantages of the prior art.

Further the invention is directed to an apparatus and method for producing such a coated base product.

To achieve these and other advantages and in accordance with the purpose of the invention, as embodied and broadly described herein, in one embodiment, the invention relates to a coated base product having a cellulosic substrate having on at least one surface thereof, a coating composition having at least about 5 percent by weight of non water soluble polymer, and up to about 90 percent by weight of clay.

In another embodiment, the invention relates to a method of applying high solids coatings to a surface of a base product utilizing a calender stack. The method comprises providing a rotatable coating roll opposing a feeding roll defining a nip portion through which a base product is passed; providing a cleaning blade in contact with the coating roll; and providing a calender box in contact with the coating roll to apply the coating.

In still a further embodiment, the present invention relates to an apparatus for applying high solids coatings to a surface of a base product utilizing a calender stack. The apparatus comprises a rotatable coating roll opposing a feeding roll defining a nip portion through which a base product is passed; a cleaning blade in contact with the coating roll; and a calender box in contact with the coating roll.

Additional features and advantages of the invention will be set forth in the description which follows, and in part will be apparent from the description, or may be learned by practice of the invention. The objectives and other advantages of the invention will be realized and attained by means of the elements and combinations particularly pointed out in the appended claims.

It is understood that both the foregoing general description and the following detailed description are exemplary and explanatory and are intended to provide further explanation of the invention as claimed.

The accompanying drawings are included to provide a further understanding of the invention and are incorporated in and constitute part of this specification, illustrate embodiments of the invention and together with the description, serve to explain the principles of the invention.

DETAILED DESCRIPTION

Figure 1:
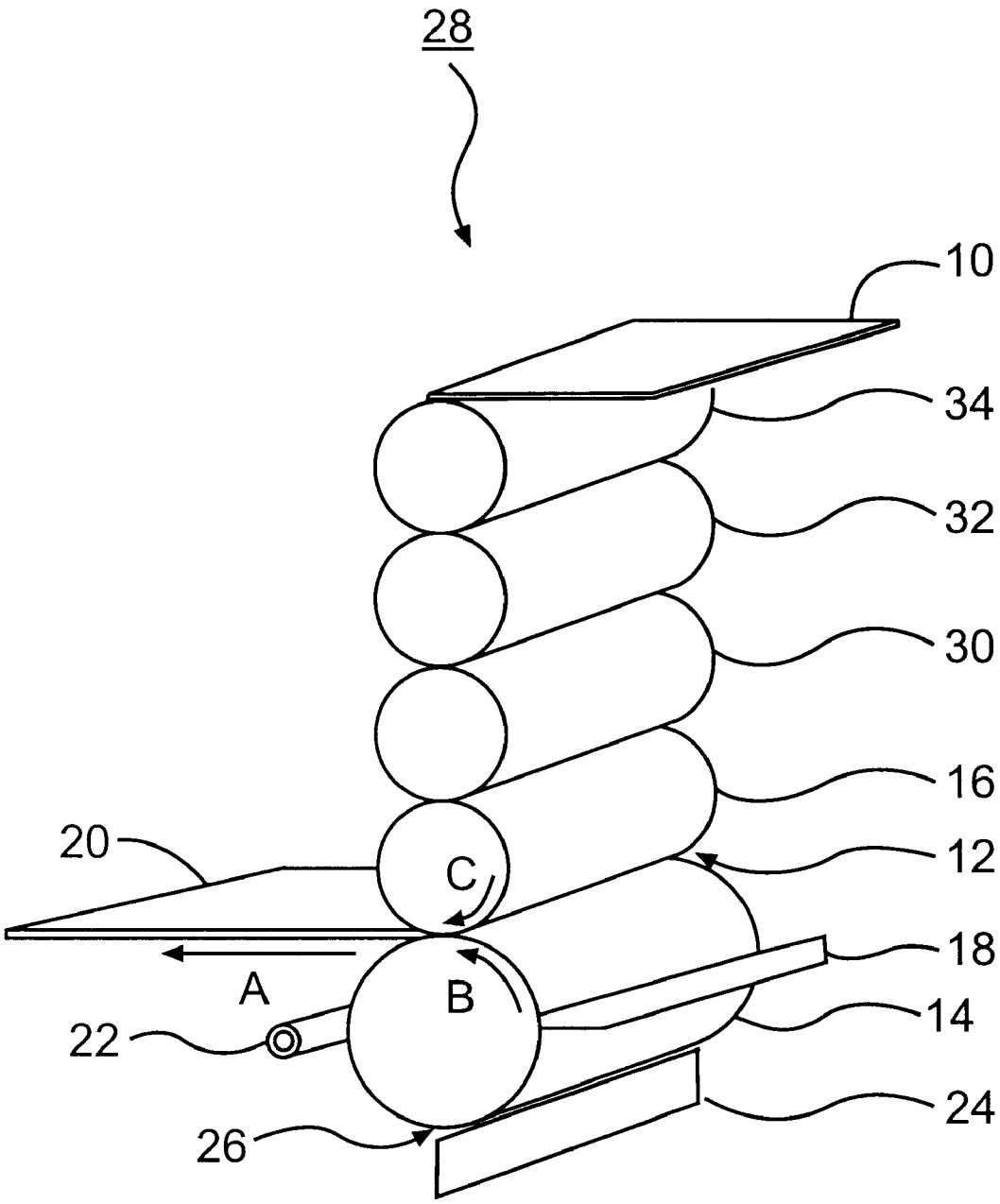
FIG. 1 is a schematic view of an apparatus illustrating an embodiment of the invention with a wet stack, coating roll, calender box, cleaning blade and shower shown in perspective.

Reference will now be made in detail to the present preferred embodiments of the invention, examples of which are illustrated in the accompanying drawings.

In accordance with the invention, there is provided a coated base product having a cellulosic substrate having on at least one surface thereof, a coating composition having at least about 5 percent by weight of non water soluble polymer, and up to about 90 percent by weight of clay.

Preferably, the coating composition has between about 5 and 40 percent by weight of non water soluble polymer, and more preferably between about 15 and 25 percent by weight of non water soluble polymer.

Preferably, the coating composition has between about 65 and 90 percent by weight of clay, and more preferably between about 75 and 80 percent by weight of clay.

The cellulosic substrate may be made of any suitable well known material. By way of example, the cellulosic substrate may be made of paper or paperboard.

Preferably, the cellulosic substrate has been subjected to sizing and contains a sizing agent. Any suitable sizing technique known in the art may be used. By way of example, suitable sizing techniques include surface sizing and internal sizing. Any suitable sizing agent known in the art may be used. By way of example, suitable sizing agents include starch, starch latex copolymers, animal glue, methyl cellulose, carboxymethyl cellulose, polyvinyl alcohol, and wax emulsions. Preferably, starch or a starch latex copolymer is employed as a sizing agent. By way of example, suitable commercially available sizing agents containing starch include "PENFORD® GUMS 200," "PENFORD® GUMS 220," "PENFORD® GUMS 230," "PENFORD® GUMS 240," "PENFORD® GUMS 250," "PENFORD® GUMS 260," "PENFORD® GUMS 270," "PENFORD® GUMS 280," "PENFORD® GUMS 290," "PENFORD® GUMS 295," "PENFORD® GUMS 300," "PENFORD® GUMS 330," "PENFORD® GUMS 360," "PENFORD® GUMS 380," "PENFORD® GUMS PENCOTE®," "PENFORD® GUMS PENSPRAE® 3800," "PENFORD® GUMS PENSURF," "PENGLOSS®," "APOLLO® 500," "APOLLO® 600," "APOLLO® 600-A," "APOLLO® 700," "APOLLO® 4250," "APOLLO® 4260," "APOLLO® 4280," "ASTRO® GUMS 3010," "ASTRO® GUMS 3020," "ASTROCOTE® 75," "POLARIS® GUMS HV," "POLARIS® GUMS MV," "POLARIS® GUMS LV," "ASTRO® X 50," "ASTRO® X 100," ASTRO® X 101," ASTRO® X 200," "ASTRO® GUM 21," "CALENDER SIZE 2283," "DOUGLAS®-COOKER 3006," "DOUGLAS®-COOKER 3007," "DOUGLAS®-COOKER 3012-T," "DOUGLAS®-COOKER 3018," "DOUGLAS®-COOKER 3019," "DOUGLAS®-COOKER 3040," "CLEARSOL® GUMS 7," "CLEARSOLS® GUMS 8," "CLEARSOL® GUMS 9," "CLEARSOL® GUMS 10," "DOUGLAS®-ENZYME 3622," "DOUGLAS®-ENZYME E-3610," "DOUGLAS®-ENZYME E-3615," "DOUGLAS®-ENZYME 3022," "DOUGLAS®-ENZYME 3023," "DOUGLAS®-ENZYME 3024," "DOUGLAS®-ENZYME E," "DOUGLAS®-ENZYME EC," "CROWN THIN BOILING X-10," "CROWN THIN BOILING X-18," "CROWN THIN BOILING XD," "CROWN THIN BOILING XF," "CROWN THIN BOILING XH," "CROWN THIN BOILING XJ," "CROWN THIN BOILING XL," "CROWN THIN BOILING XN," "CROWN THIN BOILING XP," "CROWN THIN BOILING XR," "DOUGLAS®-UNMODIFIED PEARL," and "DOUGLAS®-UNMODIFIED 1200." These sizing agents are all commercially available from Penford Products Co. "PENFORD®," "PENCOTE®," "PENSPRAE®," "PENGLOSS®," "APOLLO®," "ASTRO®," "ASTROCOTE®," "POLARIS®," "DOUGLAS®," and "CLEARSOL®" are all registered trademarks of Penford Products Co. Other suitable starches, including "SILVER MEDAL PEARL™," "PEARL B," "ENZO 32 D," "ENZO 36W," "ENZO 37D," "SUPERFILM 230D," "SUPERFILM 235D," "SUPERFILM 240DW," "SUPERFILM 245D," "SUPERFILM 270W," "SUPERFILM 280DW," "PERFORMER 1," "PERFORMER 2," "PERFORMER 3," "CALIBER 100," "CALIBER 110," "CALIBER 124," "CALIBER 130," "CALIBER 140," "CALIBER 150," "CALIBER 160," "CALIBER 170," "CHARGE +2," "CHARGE +4," "CHARGE +7," "CHARGE +9," "CHARGE +88," "CHARGE +99," "CHARGE +110," "FILMFLEX 40," "FILMFLEX 50," "FILMFLEX 60," and "FILMFLEX 70," are all commercially available from Cargill, Inc.

The non water soluble polymer may be any suitable non water soluble polymer known to the art. Preferably, the non water soluble polymer is a latex. By way of example, suitable latexes include ethylene-vinyl acetate copolymer, vinyl acetate-acrylic copolymer, styrene-butadiene copolymer, ethylene-vinyl chloride copolymer, ethylene-vinyl chloride-vinyl acetate copolymer, vinyl acetate polymer, vinyl acetate-acrylate copolymer, vinyl acetate-ethylene copolymer, acrylic polymer, styrene-acrylic copolymer and stearylated melamine.

The latex, may also be any suitable acrylonitrile-styrene-acrylic copolymer. A commercially available acrylonitrile-styrene-acrylic copolymer is "ACRONAL® S 504." ("ACRONAL® S 504" is a registered trademark of BASF Corporation.) More specifically, "ACRONAL® S 504" is an aqueous, anionic dispersion of an n-butyl-acrylate-acrylonitrile-styrene copolymer.

Another suitable non water soluble polymer includes "RAP 349 NA" comprising 50% solids of carboxylated styrene butadiene latex. "RAP 349 NA" is a trademark of DOW.

The clay may be any suitable clay known to the art. For example, suitable clays include kaolin clay, delaminated clays, structured clays, calcined clays, alumina, silica, aluminosilicates, talc, calcium sulfate, ground calcium carbonates, and precipitated calcium carbonates. Preferably the clay is selected from the group consisting of kaolin clay and conventional delaminated coating clay. A commercially available delaminated coating clay is "HYDRAPRINT" slurry, supplied as a dispersion with a slurry solids content of about 68%. "HYDRAPRINT" is a trademark of Huber.

The coating composition may also comprise other additives that are well known in the art to enhance the properties of coating compositions or are well know in the art to aid in the manufacturing process. For example, suitable additives include defoamers, antifoamers, dispersants, lubricants, film-formers and crosslinkers.

A suitable defoamer includes "FOAMASTER DF122NS." "FOAMASTER DF122NS" is a trademark of Henkel.

A suitable organic dispersant includes "DISPEX N-40" comprising a 40% solids dispersion of sodium polycarboxylate. "DISPEX N-40" is a trademark of Allied Colloids.

A suitable coating lubricant includes "BERCHEM 4095" which is a 100% active coating lubricant based on modified glycerides. "BERCHEM 4095" is a trademark of Bercen.

Preferably, the coating composition has a solids content of at least about 20%, more preferably at least about 30%, and even more preferably at least about 40%.

Preferably, the coated base product is a paper plate. Other suitable coated base products include cups, rolled brim containers, and basestock for cast coating.

Preferably, the paper plate of the invention has a grease resistance failure of less than 10%, and more preferably less than 5%. Grease resistance failure is measured using the test method described below.

In accordance with the invention, there is provided a method of applying high solids coatings to a surface of a base product. The method comprises providing a rotatable coating roll opposing a feeding roll defining a nip portion through which a base product is passed; providing a cleaning blade in contact with the coating roll; and providing a calender box in contact with the coating roll to apply the coating.

Preferably, the method of applying a high solids coating to the surface of the base product includes providing a source of liquid adjacent the surface of the coating roll between the nip portion and the cleaning blade.

Preferably, the coating roll is a king roll.

Preferably, the high solids coating to be applied by the method of the invention has a dry weight solids content of at least about 20%.

In still a further embodiment, the present invention relates to an apparatus for applying high solids coatings to a surface of a base product. The apparatus comprises a rotatable coating roll opposing a feeding roll defining a nip portion through which a base product is passed; a cleaning blade in contact with the coating roll; and a calender box in contact with the coating roll.

Preferably, the apparatus for applying high solids coatings to the surface of a base product also includes a source of liquid adjacent the surface of the coating roll between the nip portion and the cleaning blade.

Preferably, the coating roll is in a wet calender stack.

Preferably, the coating roll is a king roll.

In accordance with the invention, FIG. 1 illustrates an apparatus and a method of applying high solids coatings to a surface of a base product. As embodied herein and as illustrated in FIG. 1, a paper web 10 is fed in the direction of arrow A between the nip portion 12 defined as the point of intersection between a juxtaposed king roll 14 and a feeding roll 16. The king roll 14 rotates in the direction of arrow B and the feeding roll 16 rotates in the direction of arrow C. Preferably the king roll 14 is driven in synchronization with the feeding roll 16 in a conventional manner.

Coating is applied to the king roll 14 from a calender box 18 positioned to communicate with the king roll 14. It will be evident to those of ordinary skill in the art that any suitable coating technique known to the art may be utilized. By way of example, suitable coating techniques include those using Air Knife, Rigid Blade, Bent Blade, Rod Coaters and Jet Coaters. The coating passes around the king roll 14 and is substantially transferred to the surface of the paper web 10 to thereby form a web 20 of coated single faced paperboard, i.e., a paper web having a high solids coating on one surface thereof.

A shower 22 is positioned to spray the surface of the king roll 14 at a point after it intersects with the web 10 at the nip portion 12. The shower 22 sprays the coating roll 14 with, for example, water to prevent the excess coating remaining on the surface of the king roll 14 from drying, thus, preventing coalescing of coating on the king roll 14. The water may also include additives, for example, detergents and surfactants. It will be evident to those of ordinary skill in the art that any suitable liquid may be substituted for the water. For example, suitable liquids include $C_2$–$C_{12}$ aliphatic alcohols, other aliphatic hydrocarbons, and liquids containing silicon compounds.

A cleaning blade 24 contacts the king roll 14 at a point after which it has been sprayed by the shower 22. The point of contact between the tip of the blade 24 and the king roll 14 is denoted 26. The cleaning blade 24 removes excess coating from the surface of the king roll 14.

Figure 2:
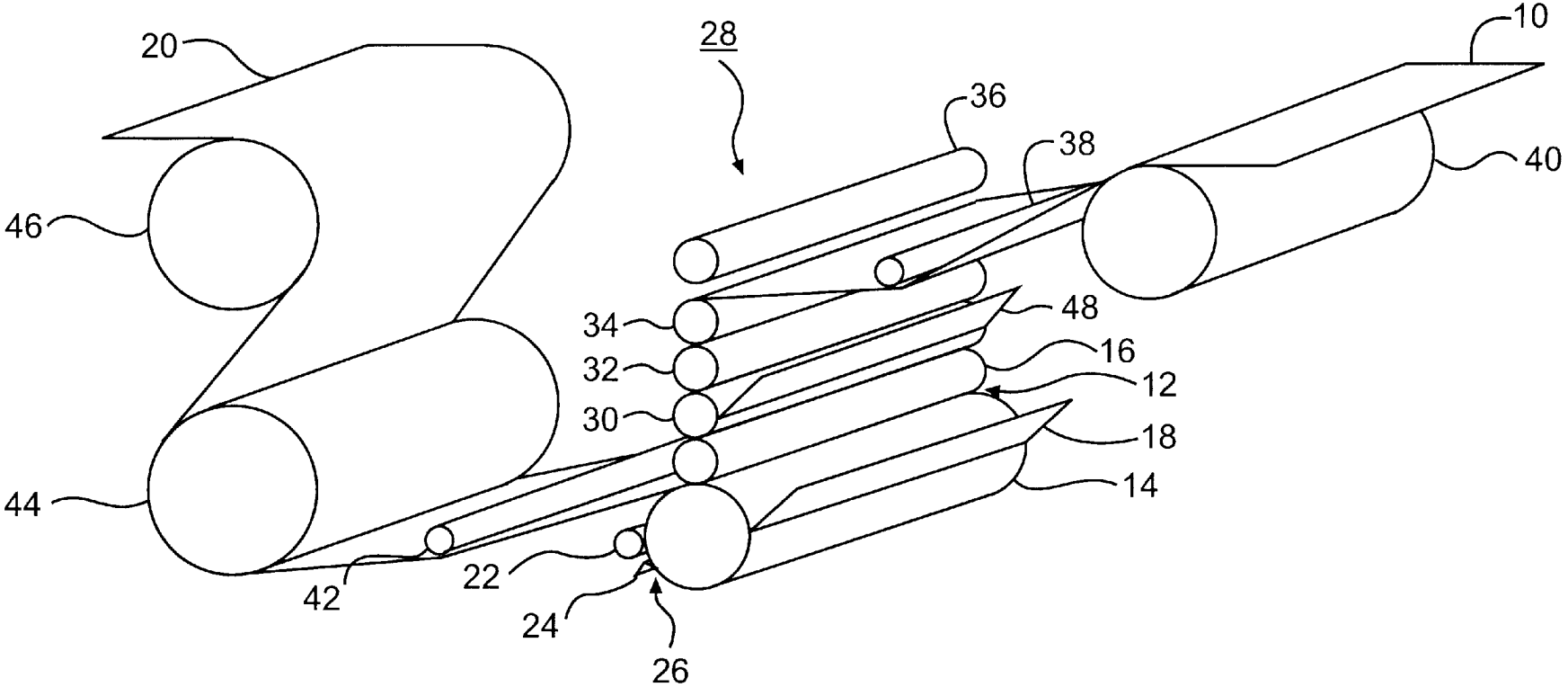
FIG. 2 is a schematic view illustrating a paperboard manufacturing process employing the apparatus of FIG. 1.

As depicted in FIGS. 1 and 2, the apparatus of the invention is preferably incorporated into the wet stack 28 of a board machine. More preferably, the apparatus of the invention is positioned at the bottom of the wet stack 28. Any suitable wet stack apparatus may be employed. The wet stack 28 depicted in FIGS. 1 comprises rotatable calender rolls 30, 32 and 34 for calendering the web 10 and feeding the web 10 to the feeding roll 16.

As depicted in FIG. 2, the apparatus of the invention can be employed as part of a paperboard manufacturing machine wherein the web 10 is fed to the wet stack 28 by guiding rolls 36, 38 and 40. By way of example, the invention may be incorporated into a paperboard manufacturing machine having no other coaters. The web 20 of coated single faced paperboard is conveyed to the next stages of the manufacturing process by guiding rolls 42, 44 and 46. As depicted in FIG. 2, additional cleaning blades 48 may be utilized in the wet stack 28 adjacent to calender rolls 30, 32 and 34.

EXAMPLES

Examples 1–5 describe the development of the present invention illustrating the advantages of the present method and apparatus for applying high solids coatings to base products. In all of the examples, a coated paperboard was produced.

Example 1

A high solids coating was applied to one of a number of calender rolls to act as a coating roll. Serious problems occurred due to coating build up on the calender rolls. Further, there was poor coating circulation in the calender box that resulted in problems, including excessive coating temperatures.

Example 2

The coating roll as described in Example 1 was subjected to "KELGIN®" sodium alginate precoating treatment. ("KELGIN" is a registered trademark of Merck & Co., Inc., Kelco Division, Rahway, N.J., U.S.A.) High solids coating was then applied to the coating roll. A significant improvement was seen to the printability of the coated paperboard.

Example 3

A high solids coating was applied to a king roll. Coating dilution problems were experienced due to the use of a king roll shower. Also, the coated paperboard was found to have coating spots, thought to be due to coating contamination.

Example 4

A high solids coating was applied to a king roll as in Example 3. However, coating filters and fine mist king roll shower heads were installed. The coated board demonstrated improved rotogravure printability.

Example 5

Coating compositions of the present invention, containing "AIRFLEX 100 HS" and having up to about 75% solids content were applied to paperboards using the method and apparatus as described in Example 4. Table 1 illustrates an example of the application of one of the high solid coating compositions. The coating ingredients were added in the order listed in Table 1. No dried coating build up or coating picking problems were experienced. The resulting coated paperboards had good ink holdout properties.

TABLE 1

| COATING INGREDIENTS | SOLIDS (%) | PARTS | DRY LBS. | WET LBS. | GALLONS |
|---|---|---|---|---|---|
| PIGMENT> | | | | | |
| Huber Hydraprint Slurry | 68.0 | 100.0 | 579.8 | 852.6 | 58.00 |
| DISPERSANT> | | | | | |
| Dispex N-40 | 40.0 | 0.02 | 0.1 | 0.3 | 0.03 |
| BINDER> | | | | | |
| Dow RAP 349 NA | 50.0 | 29.0 | 168.2 | 336.3 | 40.04 |
| LUBRICANT> | | | | | |
| Berchem 4095 (100%) | 100.0 | 1.0 | 5.8 | 5.8 | |
| DEFOAMER> | | | | | |
| Henkel Foamaster DF122NS | 100.0 | 0.1 | 0.6 | 0.6 | 0.08 |

TABLE 1-continued

| COATING INGREDIENTS | SOLIDS (%) | PARTS | DRY LBS. | WET LBS. | GALLONS |
|---|---|---|---|---|---|
| Water | N/A | N/A | N/A | 15.5 | 1.86 |
| TOTALS: | | 130.1 | 754.4 | 1211.0 | 100.0 |

Table 2 illustrates the improved grease resistance, stain resistance and geometric mean ("GM") rigidity of a paper plate coated with a high solids coating using the apparatus of the present invention when compared with a paper plate coated with a high solids coating using a typical prior art coating technique. GM rigidity is defined as $\sqrt{R_{MD} \times R_{CD}}$, where RMD is the board rigidity in the direction that the board is fed through the coating machine and RCD is the board rigidity in the cross direction. The plate grease resistance % failure and staining were measured using the test methods described below.

Test Method

Plate Grease Resistance % Failure

Three to five samples of each of the plates to be tested were collected (hereafter referred to as specimens.) 3.8 ml of "RED HF LIQUID" was added to one gallon of corn oil and mixed thoroughly to a concentration of 0.1%. "RED HF LIQUID" comprises naphthenic oil containing an organic dye and is commercially available from Dupont, Chemical and Pigments Dept., Wilmington, Del.

The corn oil mixture was heated in a 3000 ml round bottom flask to between 65–68° C. The mixture was kept at that temperature throughout testing. The heated corn oil mixture was poured onto the coated side of each specimen to a depth of 3 mm. 20 minutes after pouring the heated corn oil onto each of the specimens, the oil was removed from each specimen by scraping their surfaces with a rubber spatula. Any remaining oil was removed using paper toweling.

The non-coated side of each specimen was immediately inspected for penetration of the corn oil mixture. If penetration had occurred, the % failure of each specimen was determined by placing a PCCI grid on the non-coated side of each specimen and the number of grid blocks through which oil penetration could be seen was recorded. The % failure for each specimen was calculated by dividing the total number of grid blocks through which oil penetration could be seen by the factor noted on the PCCI grid.

Test Method

Staining 15 grams of malachite green dye, 45 ml of "GAP IGEPAL CA-520", and 15 ml of "GAP IGEPAL CA-630" were dissolved into 2,940 ml distilled or demineralized water to form a test solution.

At least three test samples were collected from each paperboard to be tested. A specific amount of the test solution was poured onto each sample for a specific amount of time.

After the specific time had elapsed the test solution was removed from the surface of the samples. The amount of staining was determined by comparison to a chart illustrating four amounts of staining on a scale including "none" (no staining), "slight," "moderate" and "great."

TABLE 2

| | (Control) | (Invention) |
|---|---|---|
| Plate Grease Resistance % Failure | 24.0 | <5.0 |
| Staining | Great | None |
| GM Rigidity | 112.6 | 129.3 |

It will be apparent to those skilled in the art that various modifications and variations can be made to the present invention without departing from the spirit or scope of the invention. Thus, it is intended that the present invention, modifications and variations of this invention provided they come within the scope of the appended claims and their equivalents.

We claim:

1. A method of applying a coating to a surface of a base product, comprising:

providing a calender stack comprising a rotatable king roll opposing a feeding roll, said rolls defining a nip portion;

providing a cleaning blade in contact with the king roll;

providing a calender box adjacent a surface of the king roll;

applying a coating material to the surface of the king roll utilizing the calender box; and passing a base product through the nip portion to apply the coating material to a surface of the base product to form the coating thereon.

2. A method of applying a coating to a surface of a base product as claimed in claim 1, wherein the coating has a dry weight solids content of at least about 20%.

3. A method of applying a coating to a surface of a base product as claimed in claim 2, further comprising:

applying a liquid to the king roll between the nip portion and the cleaning blade.

4. A method of applying a coating to a surface of a base product as claimed in claim 1, further comprising:

applying a liquid to the king roll between the nip portion and the cleaning blade.

5. A method of applying a coating to a surface of a base product as claimed in claim 1, further comprising:

providing a shower adjacent the surface of the king roll, the shower comprising a source of a liquid; and applying the liquid onto a surface of the king roll between the nip portion and the cleaning blade, wherein the liquid is capable of preventing the coating from coalescing with the king roll.

* * * * *

UNITED STATES PATENT AND TRADEMARK OFFICE

CERTIFICATE OF CORRECTION

PATENT NO. : 6,113,986

DATED : September 5, 2000

INVENTOR(S) : Shanton et al.

It is certified that error appears in the above-indentified patent and that said Letters Patent is hereby corrected as shown below:

Title page, Item [73] in the Assignee, "Company" should read --Corporation--.

Signed and Sealed this

First Day of May, 2001

*Attest:*

Nicholas P. Godici

NICHOLAS P. GODICI

*Attesting Officer*

*Acting Director of the United States Patent and Trademark Office*